United States Patent [19]

Bachl

[11] 4,029,431

[45] June 14, 1977

[54] FLUID-FLOW MACHINE

[76] Inventor: Herbert Bachl, Stolzingstr. 4/IV, Munich 81, Germany

[22] Filed: Aug. 21, 1975

[21] Appl. No.: 606,706

[30] Foreign Application Priority Data

Aug. 23, 1974 Germany ..... 2440475

[52] U.S. Cl. ..... 415/69; 415/120; 415/203; 416/186 R

[51] Int. Cl.[2] ..... F04D 31/00

[58] Field of Search ..... 415/198, 120, 178, 203, 415/199 A, 69, 82; 416/186

[56] References Cited

UNITED STATES PATENTS

| | | | |
|---|---|---|---|
| 846,971 | 3/1907 | Akimoff | 415/199 A |
| 854,012 | 5/1907 | Akimoff | 415/199 A |
| 3,226,085 | 12/1965 | Bachl | 415/199 A |
| 3,286,984 | 11/1966 | Bachl | 415/69 |
| 3,306,574 | 2/1967 | Bachl | 415/143 |
| 3,726,605 | 4/1973 | Bachl | 415/203 |

FOREIGN PATENTS OR APPLICATIONS

| | | | |
|---|---|---|---|
| 962,762 | 4/1957 | Germany | 415/198 |
| 1,001,056 | 7/1957 | Germany | 415/198 |
| 1,936,872 | 2/1971 | Germany | 415/186 |

*Primary Examiner*—Henry F. Raduazo
*Attorney, Agent, or Firm*—Christie, Parker & Hale

[57] ABSTRACT

A fluid-flow machine. At least one substantially disc-shaped rotor has a plurality of fluid-flow channels therethrough. Each fluid-flow channel comprises rectangular shaped inlet and outlet openings on opposite sides of the rotor disposed at different distances from the axis of rotation of said rotor, a tangential inlet channel portion including the inlet opening for receipt of a fluid-flow medium, a tangential outlet channel portion including the outlet opening for discharge of the fluid-flow medium and a circular radial connecting section between the channel portions having curved opposite ends connecting said inlet portion to said outlet portion completely around the perimeter thereof. Each channel portion has a direction, for directing the fluid-flow medium, which has a transverse and an axial component relative to the axis of rotation of the rotor. The axial components are in the same direction and the transverse components are in the opposite direction. The fluid-flow channels are formed so as to transform from the rectangular inlet and outlet channel portions into the curved cross-section in said radial connecting section.

4 Claims, 11 Drawing Figures

FLUID-FLOW MACHINE

BACKGROUND

The following are prior art to the present invention: U.S. Pat. No. 3,726,605 and German Pat. Specifications Nos. 962,762, 1,001,056, 1,933,070, 1,935,872; "Wirkungsgrade von Turbinen und ihre Abhaengigkeit von der Bauart", Elektrizitaetswirtschaft 1953, page 231–236, 266–270.

A fluid-flow machine is known having at least one substantially disc-shaped rotor containing fluid-flow channels whose inlet openings located on the one front side of said rotor are disposed at a different distance from the axis of rotation than the outlet openings terminating at the other front side and connected with said inlet openings through a substantially radial connecting section respectively, said inlet and outlet openings being formed such that a tangential and an axial component of the relative speed of the fluid-flow medium, occur respectively therein, the axial components being directed in the same direction and the tangential components being directed in the opposite direction.

A fluid-flow machine of this type having an axial-radial-axial flow path is described in the applicant's article "Die DS-Maschine, eine Stroemungsmaschine fuer kleine Schnellaufzahlen"published in the periodical "Brennstoff, Waerme, Kraft", 1970, pages 509–512.

In this known construction, the flow path adjacent the inlet and outlet openings is defined externally by a curved guide surface and internally by a rounded edge. The radii of curvature are located in a plane which forms an angle with the flow speed in the outer rotor opening. As the flow is redirected between the axial-tangential direction in the opening and the radial direction in the connecting section of the rotor, a relative motion with respect to the curvature path therefore occurs which results in flow losses. Since the flow path is restricted by a rectangular cross-section all along the path, additional flow losses occur in the radial connecting section due to secondary flows about the defining edges when the angle between the relative speeds in the axial sections deviates considerably from 90°.

SUMMARY OF THE INVENTION

The present invention involves a fluid-flow machine. At least one substantially disc-shaped rotor has a plurality of fluid-flow channels therethrough. Each fluid-flow channel comprises rectangular shaped inlet and outlet openings on opposite sides of the rotor disposed at different distances from the axis of rotation of said rotor, a tangential inlet channel portion including the inlet opening for receipt of a fluid-flow medium, a tangential outlet channel portion including the outlet opening for discharge of the fluid-flow medium and a circular radial connecting section between the channel portions having curved opposite ends connecting said inlet portion to said outlet portion completely around the perimeter thereof. Each channel portion has a direction, for directing the fluid-flow medium, which has a transverse and an axial component relative to the axis of rotation of the rotor. The axial components are in the same direction and the transverse components are in the opposite direction. The fluid-flow channels are formed so as to transform from the rectangular inlet and outlet channel portions into the curved cross-section in said radial connecting section. With such an arrangement a fluid-flow machine is provided which operates with efficiency while reducing flow losses.

THE DRAWINGS

Embodiments of the invention will now be described in more detail with reference to a drawing in which:

FIG. 1 is a sectional elevation through an inventive rotor,

FIG. 2 is a sectional elevation through the rotor illustrated in FIG. 1 along the line II —II, FIG. 3 to 5 are sectional elevations through the rotor illustrated in FIG. 1 along the lines III—III, IV—IV and V—V, FIG. 6 is a perspective elevation of an inventive rotor, FIG. 7 is a sectional elevation through an inventive guide wheel, FIG. 8, 9, 10 and 11 are sectional elevations through the guide wheel illustrated in FIG. 7 along the lines VIII—VIII, IX—IX, X—X, XI—XI.

DETAILED DESCRIPTION

Figure 1:
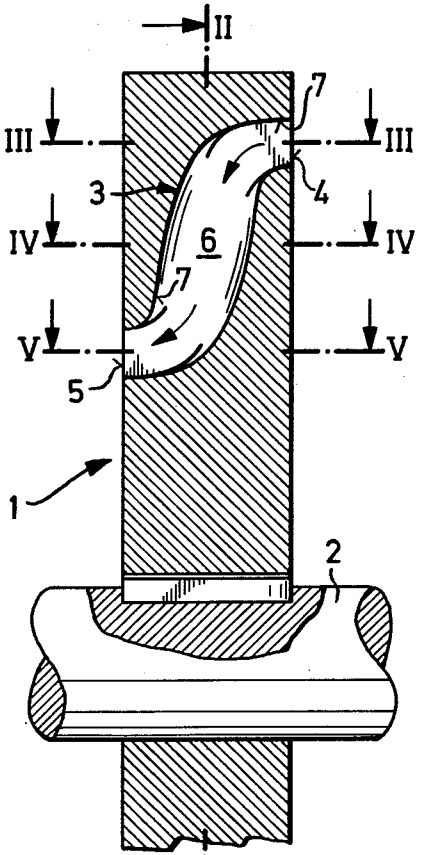

In FIG. 1 of the drawings, a rotor 1 of an inventive fluid-flow machine is illustrated which is shaped in the configuration of a disc and is non-rotatably mounted on a shaft 2. The rotor has a plurality of fluid-flow channels 3 all of which have an inlet opening 4, an outlet opening 5 and a radial connecting section 6 which connects these two openings. The inlet openings 4 in each case are respectively located on the one front side, while the outlet openings 5 are located on the other front side of the rotor. As compared to the outlet openings, the inlet openings are positioned at a greater radial distance from the axis of rotation of the shaft 2 than the outlet openings.

Figure 3:
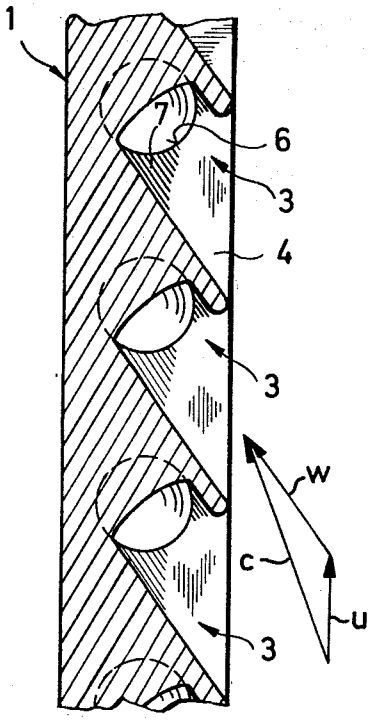
Figure 5:
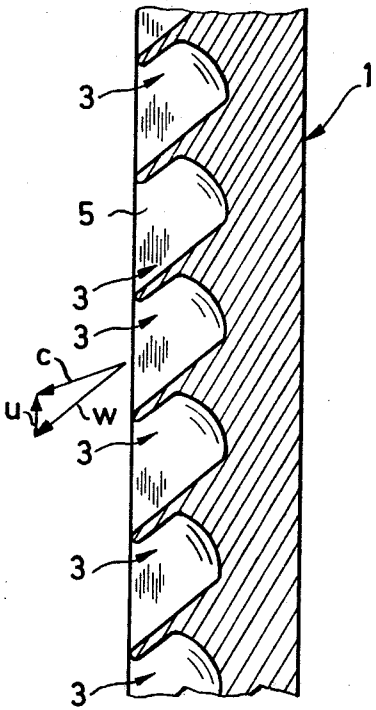

FIGS. 3 and 5 reveal that the inlet and outlet openings are designed such that in them a tangential (or transverse direction relative to the axis of rotation) and an axial component of the relative speed of the fluid-flow medium occurs, the axial component being respectively directed in the same direction and the tangential component in the opposite direction respectively. In both FIGS. 3 and 5 are shown velocity vector diagram, in which the arrow W indicates the relative speed, arrow C the absolute speed and arrow u the rotational speed.

Figure 2:
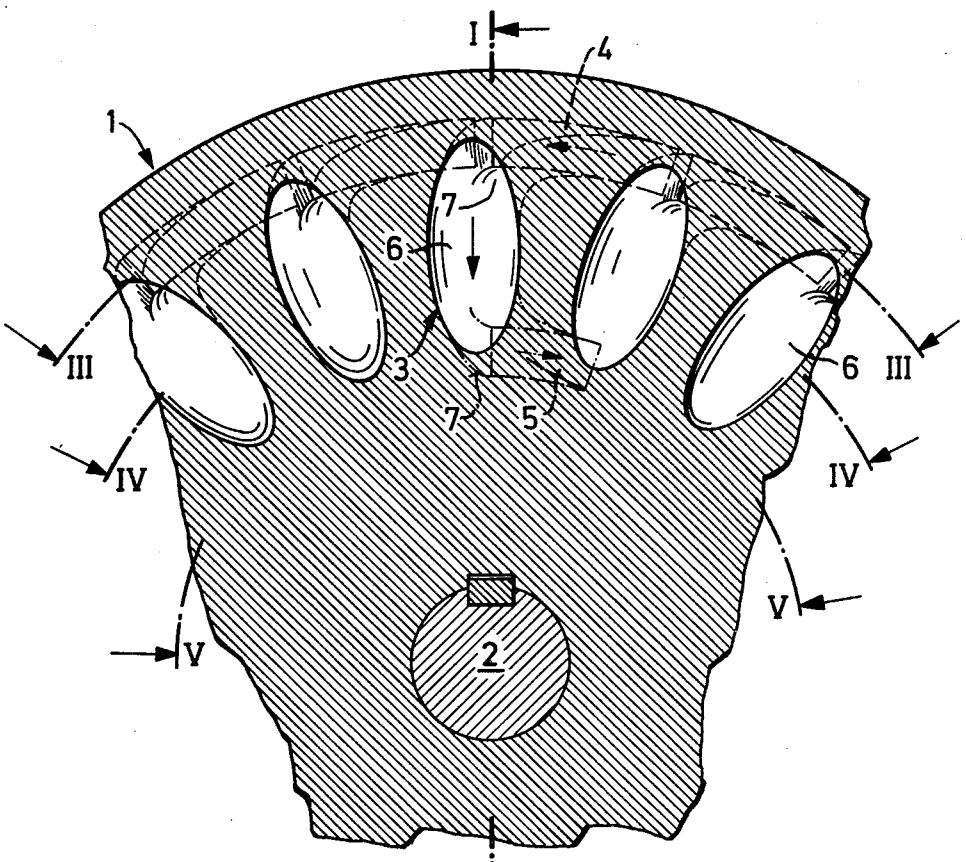
Figure 4:
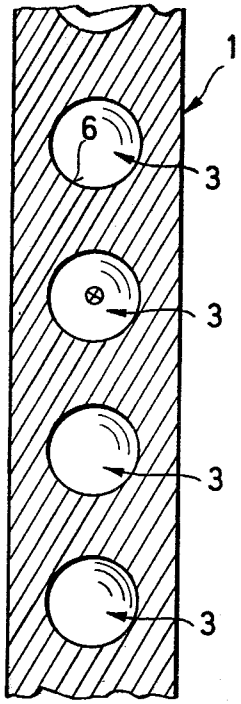
Figure 6:
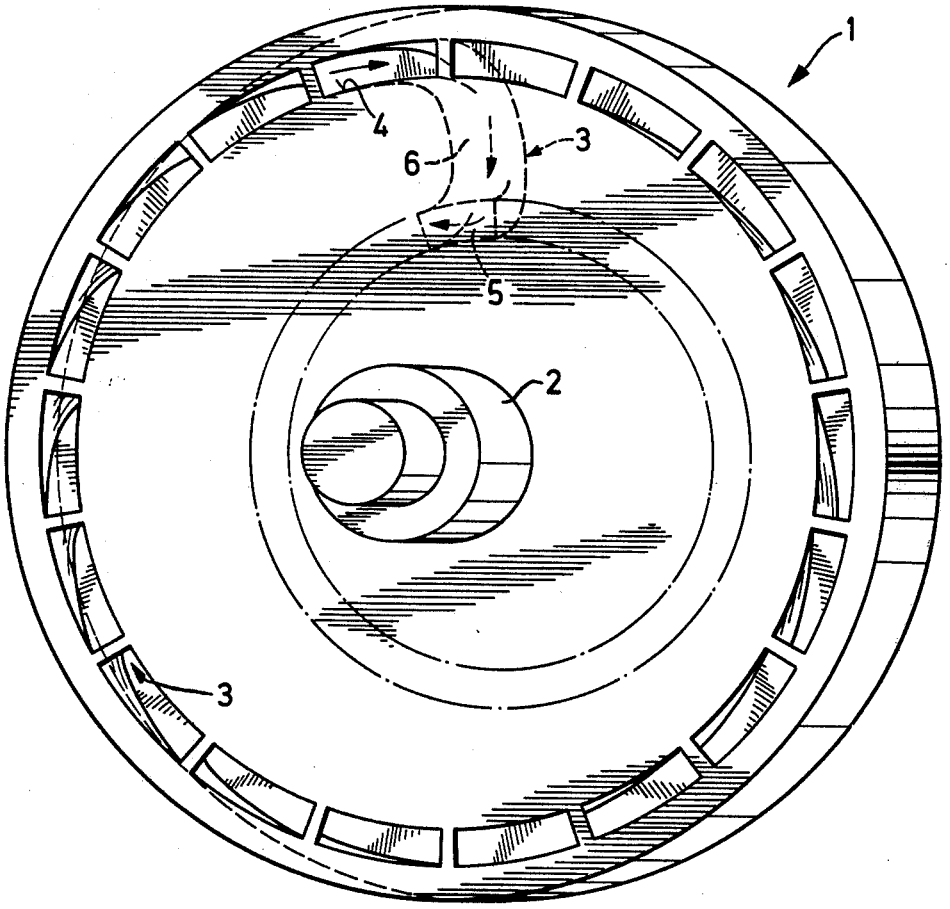

FIGS. 2 and 6 reveal that both the input and output openings have a substantially rectangular configuration. FIG. 4 reveals that the connecting section has a circular cross-section. The inlet and outlet openings are connected with the radially traversed connecting section 6 of the fluid-flow channel through curved portions 7 whose radii of curvature are at least closely adjacent the openings in a plane which coincides with the plane of the relative speed of the fluid-flow medium in the part of said curved portion which is adjacent the opening.

In the transition area between the inlet and outlet openings and the connecting section, the corners of the originally rectangular fluid-flow cross-section extend toward the connecting section such that the rectangular cross-section gradually becomes circular in shape from the outside toward the inside.

Figure 7:
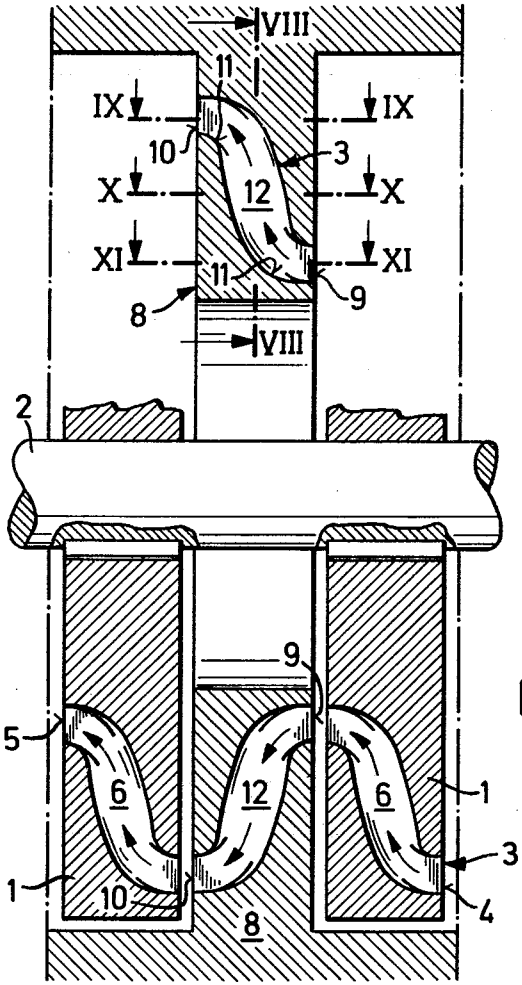
Figure 11:
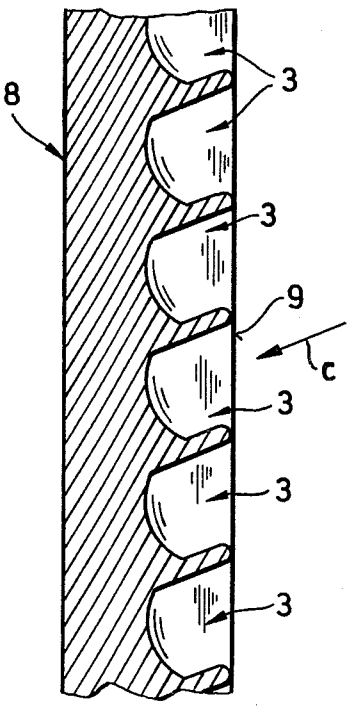
Figure 10:
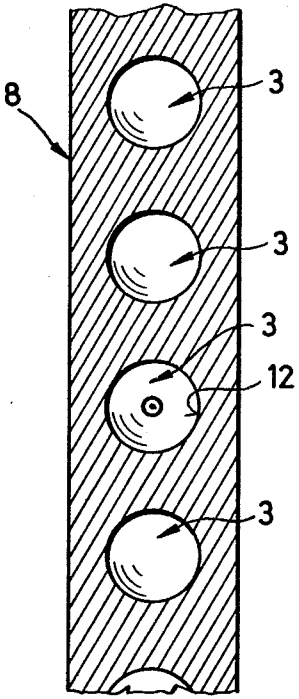

In the upper region of FIG. 7, a guide wheel 8 is shown which is conceived for a multi-stage embodiment of the inventive fluid-flow machine as is indicated at the bottom of FIG. 7. The guide wheel has fluid-flow channels which are designed in mirror image with respect to the fluid-flow channels of the rotor 1. The respective inlet openings 9 and outlet openings 10 have a rectangular configuration exactly as in the case of the rotor. This is also evident from FIGS. 8, 9 and 11 as well. The outlet openings are also connected to a curved portion 11 which provides the transition to the radial connecting section 12. Unlike the rotor, however, the inlet openings in the guide wheel are positioned more closely to the axis of rotation of the rotors than the outlet openings 10. The result is that the fluid-flow medium flows outwardly in the radial connecting section in a radial direction.

The fluid-flow cross-section, which is initially rectangular, has corners extending toward the connecting section in the region of the inlet and outlet openings. The rectangular cross-section in the outer area is thereby continuously transformed into a circular cross-section in the region of the connecting section.

As in the case of the rotor, the inlet and outlet openings are also shaped such that a tangential and an axial component of the relative speed of the fluid-flow medium occurs in each case, the axial component being directed in the same direction and the tangential component in the opposite direction respectively. The tangential component in the case of the guide wheel is opposite that of the rotor. In the FIGS. 9 and 11 there is indicated the relative speed by an arrow C.

Figure 8:
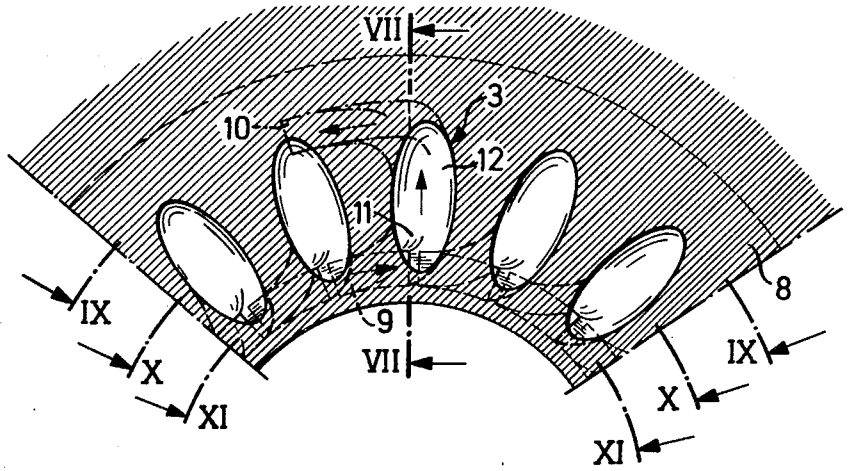
Figure 9:
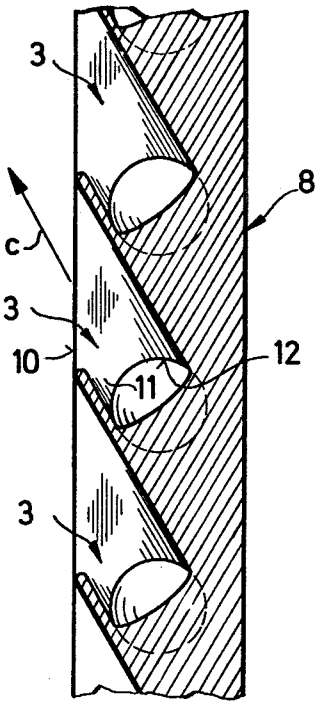

The respective inlet and outlet openings of the rotor and guide wheel are indicated by dotted lines in FIGS. 2 and 8. In FIG. 6 of the drawing, a perspective elevation of a rotor is shown in the course of the fluid-flow channel inside the rotor rendered visible by dotted lines.

A multi-stage arrangement is shown in the lower region of FIG. 7. A rotor 1 secured to a common shaft is respectively located on both sides of a stationary guide wheel 8. The flow path is indicated by arrows.

The invention is not restricted on the shown embodiment. It is as well possible to provide a centrifugal flow direction in the rotor and a centripetal flow direction in the guide wheels.

What is claimed is:

1. A fluid-flow machine comprising:

at least one substantially disc-shaped rotor, said rotor having a plurality of fluid-flow channels therethrough, each said fluid-flow channel comprising rectangular shaped inlet and outlet openings on opposite sides of said rotor disposed at different distances from the axis of rotation of said rotor, a tangential inlet channel portion including said inlet opening for receipt of a fluid-flow medium, a tangential outlet channel portion including said outlet opening for discharge of the fluid-flow medium, and a circular radial connecting section between said channel portions having curved opposite ends connecting said inlet portion to said outlet portion completely around the perimeter thereof;

each said channel portion having a direction, for directing the fluid-flow medium, which has a transverse and an axial component relative to the axis of rotation of the rotor, the axial components being in the same direction and the transverse components being in the opposite direction, said fluid-flow channels being formed so as to transform from the rectangular inlet and outlet channel portions into the curved cross-section in said radial connecting section.

2. A fluid-flow machine according to claim 1 wherein said curved opposite ends each have a radii of curvature which extends substantially into alignment with a plane extending tangentially in the corresponding channel portion.

3. A fluid-flow machine according to claim 2 wherein said radii of curvature is the radius of said circular cross-section.

4. A fluid-flow machine comprising:

a plurality of rotors;

at least one guide wheel located between said plurality of rotors;

said rotors each comprising a plurality of fluid-flow channels therethrough, each said fluid-flow channel comprising rectangular shaped inlet and outlet openings on opposite sides of said rotor disposed at different distances from the axis of rotation of said rotor, a tangential inlet channel portion including said inlet opening for receipt of a fluid-flow medium, a tangential outlet channel portion including said outlet opening for discharge of the fluid-flow medium, and a circular radial connecting section between said channel portions having curved opposite ends connecting said inlet portion to said outlet portion completely around the perimeter thereof;

each said channel portion having a direction, for directing the fluid-flow medium, which has a transverse and an axial component relative to the axis of rotation of the rotor, the axial components being in the same direction and the transverse components being in the opposite direction, said fluid-flow channels being formed so as to transform from the rectangular inlet and outlet channel portions into the curved cross-section in said radial connecting section;

said at least one guide wheel having fluid-flow channels in mirror image to the corresponding portions of said rotors and comprising inlets and outlets which are rectangular shaped in cross-section and a radial connecting section therebetween, said radial connecting section having a cross-section which is curved completely around the perimeter thereof, the fluid-flow channels of said guide wheel forming a transition from the rectangular cross-section of the inlet and outlet openings thereof into the curved cross-section of the radial connecting section thereof.

* * * * *